US009376186B2

(12) United States Patent
Brizzolara et al.

(10) Patent No.: US 9,376,186 B2
(45) Date of Patent: Jun. 28, 2016

(54) MARINE TUNNEL THRUSTER

(76) Inventors: Enrico Bruno Brizzolara, Bardonecchia (IT); Stefano Brizzolara, Genoa (IT)

( * ) Notice: Subject to any disclaimer, the term of this patent is extended or adjusted under 35 U.S.C. 154(b) by 86 days.

(21) Appl. No.: 14/008,122

(22) PCT Filed: Apr. 4, 2012

(86) PCT No.: PCT/IB2012/051653

§ 371 (c)(1),
(2), (4) Date: Oct. 3, 2013

(87) PCT Pub. No.: WO2012/137144

PCT Pub. Date: Oct. 11, 2012

(65) Prior Publication Data

US 2014/0057506 A1 Feb. 27, 2014

(30) Foreign Application Priority Data

Apr. 5, 2011 (IT) ..... GE2011A0036

(51) Int. Cl.
*B63H 5/14* (2006.01)
*B63H 11/04* (2006.01)

(52) U.S. Cl.
CPC . *B63H 5/14* (2013.01); *B63H 11/04* (2013.01)

(58) Field of Classification Search
CPC ..... B63H 25/46; B63H 5/15; B63H 5/16; B63H 5/14
USPC ..... 440/38, 47, 67
See application file for complete search history.

(56) References Cited

U.S. PATENT DOCUMENTS

| | | | | |
|---|---|---|---|---|
| 3,464,357 | A * | 9/1969 | DuPort | B63H 25/46 114/151 |
| 3,471,080 | A * | 10/1969 | Gray | 415/119 |
| 3,517,633 | A * | 6/1970 | Wanzer | 114/151 |
| 5,306,183 | A | 4/1994 | Holt | |
| 6,325,683 | B1 * | 12/2001 | Yocom | 440/6 |
| 6,482,054 | B2 * | 11/2002 | Treaster et al. | 440/38 |
| 8,584,609 | B2 * | 11/2013 | Stasolla et al. | 114/151 |
| 2011/0073029 | A1 | 3/2011 | Stasolla | |

FOREIGN PATENT DOCUMENTS

| | | |
|---|---|---|
| DE | 3712534 | 11/1988 |
| DE | 10234015 | 2/2004 |
| EP | 0396151 | 11/1990 |
| FR | 2270461 | 12/1975 |
| WO | 0192101 | 12/2001 |
| WO | 2007093309 | 8/2007 |

* cited by examiner

*Primary Examiner* — Andrew Polay
(74) *Attorney, Agent, or Firm* — Themis Law

(57) ABSTRACT

Marine tunnel thruster includes a duct, within which at least a propeller is fitted that is operatively connected to a rotational drive system. The duct is composed of three sections, which include a first central section and two end sections. The first central section has a specific length and a specific diameter, while the two end sections have a specific length and a specific diameter greater than the diameter of the central section.

13 Claims, 11 Drawing Sheets

MARINE TUNNEL THRUSTER

FIELD OF THE INVENTION

The present invention relates to a marine tunnel thruster comprising a tubular duct, within which at least a propeller is fitted that is operatively connected to drive means for rotation about an axis parallel to, particularly coinciding with, the longitudinal axis of said duct.

BACKGROUND OF THE INVENTION

Thrusters of said type are known from the prior art. Such systems have become a very important piece of equipment, allowing movements of floating vehicles to be facilitated, above all, but not exclusively, in the marine field.

By the installation of one or more of these tunnel thrusters in the quickwork of a vessel, a boat, a watercraft, or a floating transport or working vehicle, it becomes possible not only to increase maneuvering and evolution ability of the vehicle upon which they are mounted, but it is also possible to help in the implementation of their dynamic positioning system.

Such systems are generally arranged transverse to the fore-and-aft axis of the marine unit in the quickwork of the hull and the tubular duct comes out at the sides of the hull where apertures are provided coinciding with the ends of said tunnel. Still generally, the axis of rotation of the propeller inside the duct is arranged transverse to the fore-and-aft axis of the marine vehicle.

Therefore, by the rotation of the propeller, a hydrodynamic force is generated which allows the marine unit to be turned or moved sideways as it is necessary during maneuvers such as for instance docking.

Because of the limited draft of the hull often it is not possible to install the propeller having the most suitable diameter in relation to the required power and to the overall length of the tunnel. In these cases the thrust values that can be obtained will be always lower than the maximum values that can be obtained in relation to the installed power.

In order to overcome such drawback, one tries to avoid hydrodynamic turbulences on the inner walls of the duct, since the thrust supplied by the propeller decreases more and more as the length relative to the diameter of the duct increases, due to major head losses throughout the walls of the tunnel and due to the local ones at the ends met by the water flow generated by propeller action.

A known solution is described in several documents, such as document GB112094, document U.S. Pat. No. 3,400,682 and document EP0037865. In these documents different arrangements of marine tunnel thrusters comprising propellers housed into ducts are described. These ducts provide two end flares, arranged at the ends of the duct respectively.

Such arrangement would allow hydrodynamic conditions on the inner walls of the duct near the end sides thereof to be improved. Notwithstanding this, such arrangement does not eliminate fractional resistances of the flow along the inner walls of the duct, which are still able to reduce the propeller thrust, since in order to reach the thrust required by the vessel for the manoeuvre a greater amount of power must be used.

SUMMARY OF THE INVENTION

The invention therefore aims at providing a marine tunnel thruster of the type described hereinbefore, wherein the duct substantially has a hydrodynamic profile reducing the hydrodynamic resistance to the water flow generated by the tunnel propeller, optimizing propeller thrust.

The invention achieves the above aims by providing a marine tunnel thruster as described hereinbefore, wherein the tubular duct is composed of three sections, which include a first central section extending at each end side by an end section, the first central section housing at least one propeller and having a specific length and a specific diameter, while the two end sections have a specific length and a specific diameter greater than the diameter of the central section, said end sections being connected to said central section by an annular radial enlargement having a steep face.

According to the just described arrangement the propeller is arranged within the central section and it has a diameter slightly lower than the inner diameter of the central section.

The two end sections are therefore connected to one end side and to the other end side of the central section by abrupt annular connections that form a diameter jump having, in the direction of the longitudinal axis of the duct and in section according to a diametric plane, a steep profile with an axial extension of a specific value.

This feature allows turbulences inside the duct to be considerably reduced, since the major and local resistances of the accelerated flow are mainly provided in the central tunnel and are almost zero in the outer sections, as in the outlet one where, due to the abrupt enlargement in the diameter of the duct of the central section, its walls do not significantly interfere anymore on the friction losses.

Contemporaneously, in the other end section, the inlet one, the major friction losses and the local ones at the connection are significantly reduced due to the reduction in the local velocity.

Additional improvements of the general arrangement just described are mainly directed to further decrease the major and local losses of the hydrodynamic flow generated by the propeller, in order to optimize the thrust allowing the marine vehicle to be maneuvered, exploiting at best the available power of the propeller.

In particular the connecting surfaces have a specific extension according to the longitudinal axis of the duct that is a function of the difference between the diameter of each of the two end sections with respect to the diameter of the central section.

Advantageously the value of the extension of the connecting surface in the direction of the longitudinal axis does not depend only on said diameter difference, but it is also lower than the value of said difference of the two diameters multiplied by a multiplicative factor.

Experimental tests have proved that in order to obtain the maximum performance of the thrust flow generated by the propeller as a function of the absorbed power, that is, in order to minimize hydrodynamic losses, the multiplicative factor should fall within a range from 0.4 to 4.0, depending on the particular shape of the connecting surface.

In general the connections between the central section and the two end sections will be always abrupt, with one or more sharp steps or with limited gradually leading connecting surfaces, which develop for a limited length, generally lower than 4 times the difference in the diameter of the end sections with respect to the diameter of the central section.

A possible embodiment for minimizing the local losses at the end of the central section provides for a length of the connection between the end of the central section and the facing connecting end of the end section, according to the longitudinal axis of the tubular duct, expressed by the relation:

$$a=k(De-Di)$$

where:

a is the length of the connecting surface

De is the diameter of each one of the end sections

Di is the diameter of the central section, substantially equal to, excepting the intereference tolerance, the diameter of the thruster propeller k=1, if the connection has the shape of an ellipse quarter having the main diameters in the ratio 2:1, otherwise it ranges from 0 0.4 to 4.0.

Advantageously in order to optimize the propeller thrust it is possible to find a suitable ratio of the size of the diameter of each of the two outer sections to the size of the diameter of the central section. Experimental tests made on the tunnel thruster of the present invention have proved that preferably the size of the diameter of each of the two outer sections must have a value falling within a range, whose limits are defined by the size of the diameter of the central section, multiplied by two multiplicative factors respectively, which include a first factor for defining the lower limit and a second factor for defining the upper limit.

The lower limit and the upper limit must be defined from time to time as a function of the overall length measured between the inlet and outlet sections of the duct, as well as of the velocity of the water flow coming out from the central section, such to avoid contacts between the outer turbolent surfaces thereof and the walls of the end section.

For instance as regards ducts with an overall length equal to about 4 times the diameter of the propeller and/or of the central section, the first factor can range from 1.01 to 1.20, while the second factor can range from 1.50 to 2.50.

A variant embodiment of the marine tunnel thruster of the present invention provides for the axial length of the central section of the tunnel to be defined as a function of its own diameter, preferably according to a factor ranging from 2 to 4.

The connecting surface can be provided with different shapes, which help in modulating the hydrodynamic reductions of the thrust generated by the propeller. All these different shapes allow for an abrupt enlargement to be maintained in the diameter of the duct near the end sides of the central section.

A first embodiment provides for the connecting surface to be abrupt with one or more steps, wherein the annular connecting enlargement of the facing end sides of the central section and or the corresponding end section is composed of one or more perfectly radial, annular surfaces, all perpendicular to the longitudinal axis of the tubular duct.

Thus the end sides of the central section are connected to the ends of each of the two end sections by two or more surfaces perpendicular to each other.

As an alternative the connecting surface can have a frustum conical shape.

Said frustum conical surface can have opening angles corresponding to all the possible inclinations of the shell wall with respect to the central longitudinal axis of the tubular duct, ranging from 20° to 90°.

In another embodiment the connecting surface can be curved with a concavity faced towards the inner or outer side of the tubular duct.

The profile can be composed of any curve, but from a manufacturing point of view, it can be preferable to use a shape with a constant radius of curvature (a sector of a circle, in section) or with a progressively changing radius (a sector of ellipse, in section).

Moreover, such shapes allow the hydraulic head loss to be limited at the entrance of the connecting surface, and to reduce its influence on the thrust created by the propeller.

Advantageously a duct, included in the marine tunnel thruster according to the present invention, is provided mounted into the hull of a marine vehicle.

A thruster according to the invention is particularly suitable for a marine vehicle, wherein the overall length of the tunnel has a size equal to or greater than about three times the diameter of the propeller fitted therein.

A first embodiment provides for the duct to be oriented with its own longitudinal axis transverse to the fore-and-aft axis of the vehicle, such that the two end sections come out at opposite sides of the hull, through two apertures which, depending on the motions and speeds of the marine vehicle, will be suitably shaped.

The perpendicularity between the longitudinal axis of the duct and the fore-and-aft axis of the marine vehicle was usual, and therefore not a possible option, in devices known in the prior art, since the transverse thrusters could operate well into ducts with a limited length with respect to the diameter of the propeller, in order to supply the thrust necessary to move the vehicle.

The thruster of the present invention, by reducing the hydrodynamic resistances along the variable-geometry duct and therefore by obtaining the maximum thrust performance of the propeller, can be mounted also with the axis of the duct not perpendicular to the fore-and-aft direction of the marine vehicle.

Therefore, it is possible to mount the thruster of the present invention on transport and working marine vehicles, on vessels and boats characterized by low values of the length/width ratio or even characterized by local ratios, related to the width of the tunnel section of interest having a value lower than 10.

Another possible embodiment provides for installing two or more of these marine tunnel thrusters, mounted, according to the characteristics described up to now, with an angle of about 45° with respect to the main axes of the marine vehicle.

One embodiment provides for four marine tunnel thrusters to be mounted at 45° at four corners of a marine vehicle having low values of the length/width ratio, such as for example a vehicle with a total length of 60 m and a total width of 30 m.

The thrust actions of the propellers, belonging to each one of the 4 ducts, inclined by 45° will compose vectorially a resulting force that as regards intensity and direction can be modulated according to need, by changing the speed and the direction of rotation with propellers with fixed vanes or pitch angle and rotational speed for propellers with adjustable vanes.

According to a variant embodiment the duct belonging to a marine thruster according to the present invention is provided within a hull of a marine working floating vehicle or a vessel or a boat.

According to an improvement of the variant embodiment just described, such duct is in communication with an additional duct provided arranged with the longitudinal axis coinciding with and/or parallel to the fore-and-aft axis of the vessel and emerging outside the hull at the bow, through an aperture.

According to an improvement of the variant embodiment just described, at the other end the additional duct is connected to one of the two end sections of a duct according to the present invention through a connecting surface made according to one or more of the above described characteristics and related to the surfaces connecting the end sections with the central section of the duct.

Advantageously the flow coming out from one of the two end sections, pushed by the propeller fitted in the central section, does not contact the walls of the end sections, allowing for a transverse thrust value to be obtained that is much higher than that obtainable by the same driving power using a larger propeller equal to the diameter of the end sections.

The present invention relates to a vessel, a boat, a watercraft or other transport or working vehicle, or other floating vehicles wherein at least one tunnel maneuvering propeller is fitted, whose axis of rotation is at a level equal to or lower than the waterline of the hull.

According to the present invention the above described tubular duct is composed of three sections, which include a first central section and two end sections, the first central section having a specific length and a specific diameter, and the two end sections having a specific length and a specific diameter, which is greater than the diameter of the central section while said end sections are connected to said central section by an annular radial enlargement of any type and shape, but always with a face steep enough for causing, at the downstream connection, the flow accelerated by the propeller to be clearly detached from the walls of the end section.

The duct with the maneuvering propeller can have also one or more of the combinations or subcombinations of the previously described characteristics for the marine tunnel thruster.

The invention relates also to other characteristics that further improve the marine tunnel thruster and/or the above marine vehicles that are the object of the dependent claims.

BRIEF DESCRIPTION OF THE DRAWINGS

These and other characteristics and advantages of the present invention will be clearer from the following description of some embodiments shown in the annexed drawings wherein.

DETAILED DESCRIPTION OF EMBODIMENTS OF THE INVENTION

Figure 1A:
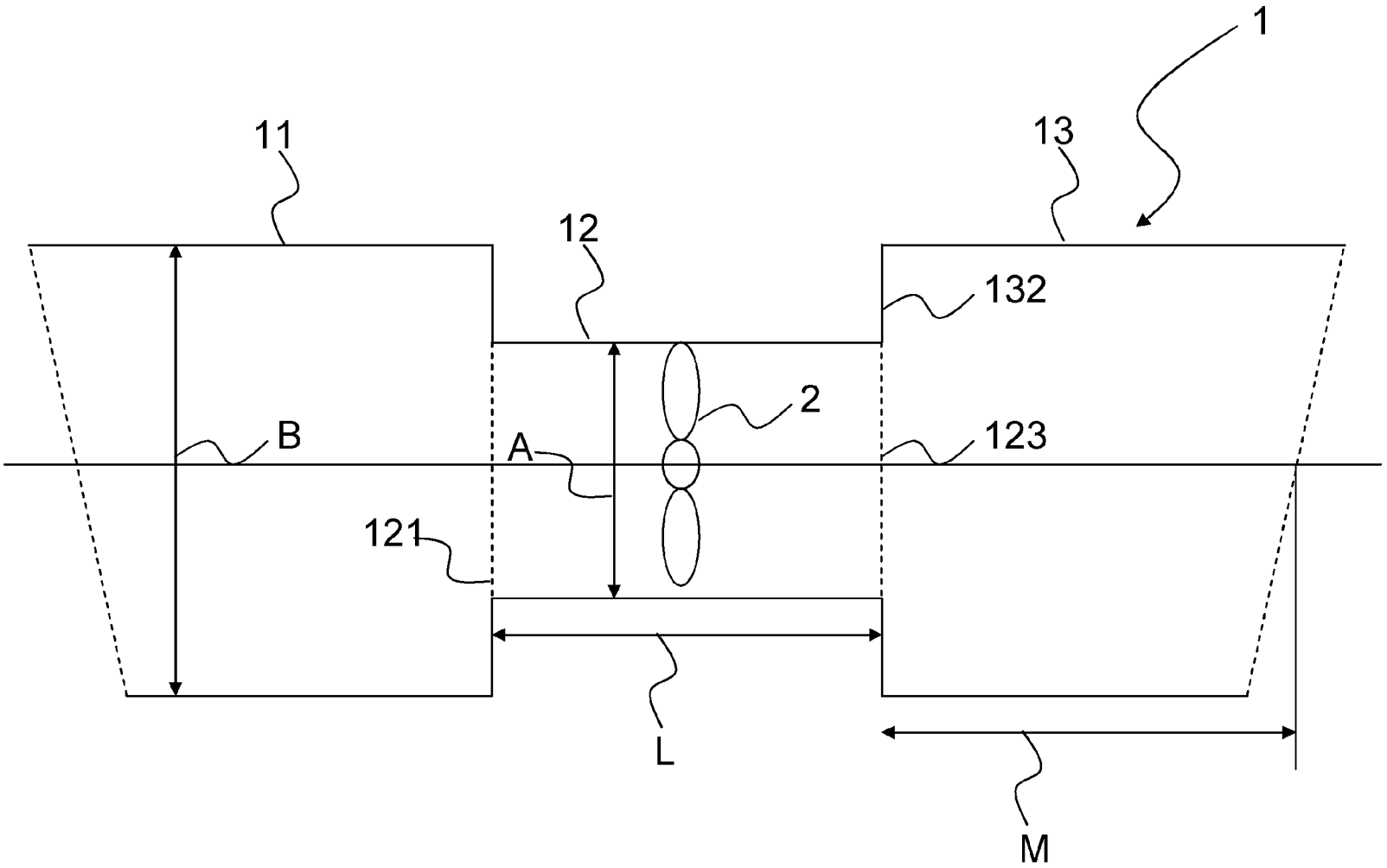
FIG. 1*a* is a marine tunnel thruster according to the present invention according to a diametric section wherein the connecting surface is in the form of a step-like connection.

FIGS. 1*a* to 3*b* show several, but not all, embodiments of the marine tunnel thruster of the present invention.

A marine tunnel thruster according to the present invention generally comprises a tubular duct 1 within which a propeller 2 is fitted operatively connected to drive means, not shown in the figures, for the rotation about an axis parallel to, in particular coinciding with, the longitudinal axis of the duct 1.

The tubular duct 1 is composed of three sections 11, 12 and 13, of which a first central section 12 extends at each end side 121, 123 with end sections 11 and 13.

The propeller 2 is housed within the central section 12, which has a specific axial length L and a specific diameter A.

The two end sections 11 and 13 have a specific axial length M and a specific diameter B greater than the diameter A of the central section 12 and are connected to the central section 12 by an annular radial enlargement having a steep or abrupt face.

The end section 11 is particularly connected to the end side 121, while the end section 13 is connected to the end side 123, both by means of an annular connecting surface forming a diameter jump having, in the direction of the longitudinal axis of the duct and in a section according to a diametric plane, a steep profile or step with an axial extension with a suitable length.

FIGS. 1*a* to 3*b* show variant embodiments of a marine tunnel thruster of the present invention where the propeller 2 is always arranged in a central position within the central section 12. However it is possible to provide different positioning of the propeller 2 inside the central section 12.

It is also possible to provide more than one propeller, in particular 2 propellers having a direct axial coupling, namely rotating in the same direction, or counter-rotating.

Regardless of the number and type, propellers are preferably mounted inside the central section 12 and are connected to a motor for the movement thereof, which can be arranged inside or outside the duct 1.

The connecting surface has a specific extension in the direction of the longitudinal axis of the duct 1, which is a function of the difference in the size of the diameter B of each of the two end sections 11 and 13 with respect to the size of the diameter A of the central section. In particular such extension is smaller than the value of the difference of the size of diameter B of each one of the two end sections 11 and 13 to the size of the diameter A of the central section 12, which value is multiplied by a multiplicative factor.

Experimental tests, provided with numerical simulations, have proved that such multiplicative factor ranges from 0.4 to 4.0 depending on the particular shape of the connecting surface.

In each variant embodiment of the marine tunnel thruster of the present invention, the diameter of each one of the two end sections 11 and 13 is a function of the diameter A of the central section 12 and of the average velocity of the hydrodynamic flow generated by the propeller.

Consequently the size of the diameter B of the end sections 11 and 13 is given on the basis of the size of the values of the diameter A of the central section 12 and of the velocities of the water coming out therefrom. In particular the diameter B of the end sections 11 and 13 has a size taken from a value within a range defined by the size of the diameter A of the central section 12 multiplied by a first factor that defines the lower limit of the range and multiplied by a second factor that defines the upper limit of the range.

The lower limit and the upper limit have to be defined from time to time as a function of the overall length measured between the inlet and outlet sections of the duct, as well as the velocity of the water flow coming out from the central section, such to avoid contacts between the turbulent outer surfaces thereof and the walls of the end section.

For instance, as regards ducts with an overall length equal to a size corresponding to about 4 times the diameter of the propeller and/or of the central section, the first factor can have a value ranging from 1.01 to 1.20, while the second factor can have a value ranging from 1.50 to 2.50.

A further variant embodiment of the marine tunnel thruster of the present invention can also provide special devices for further increasing the tunnel performance.

Figure 1B:
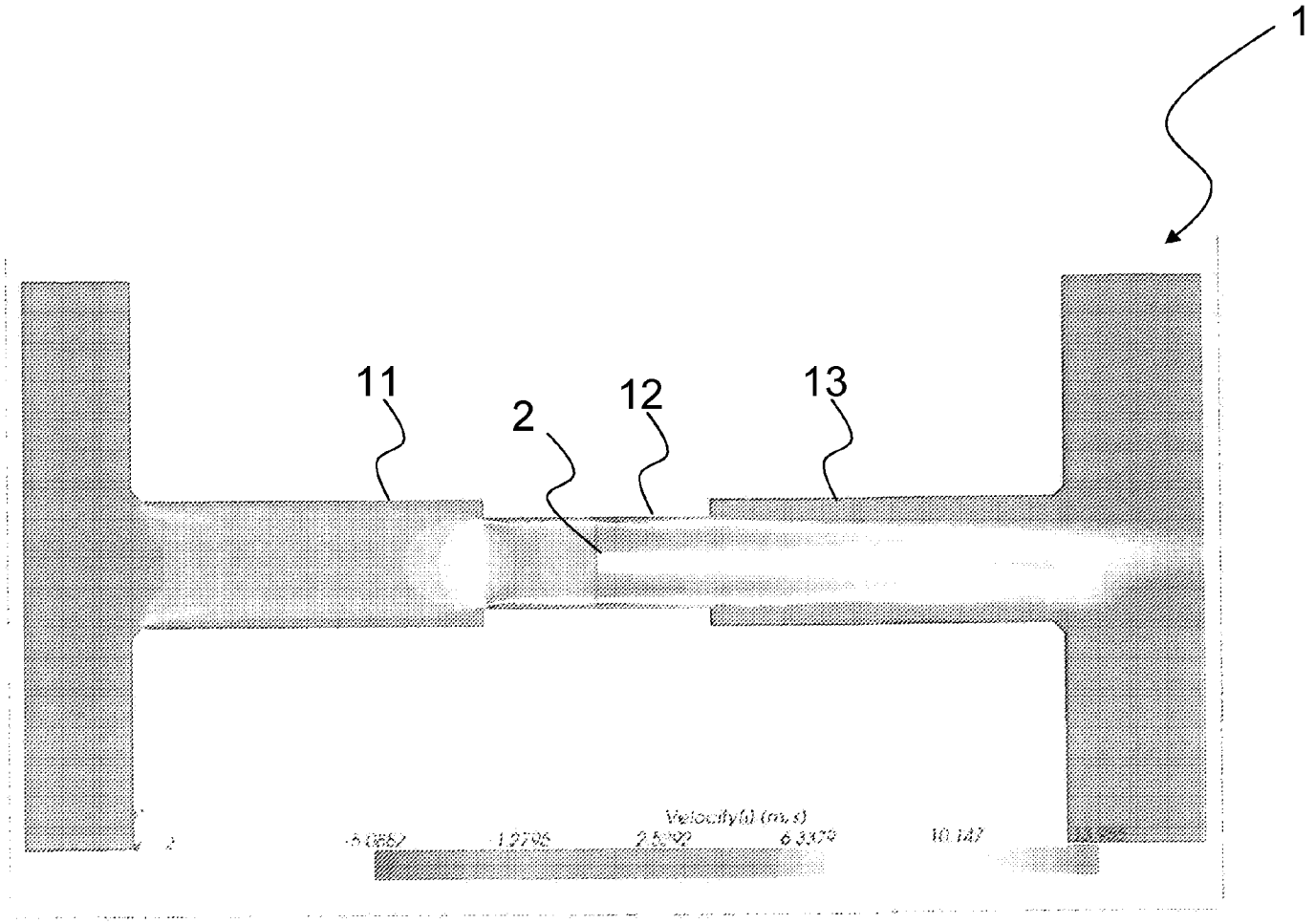
FIG. 1*b* shows how the velocity of the inner duct belonging to a marine tunnel thruster of the present invention changes.
Figure 1C:
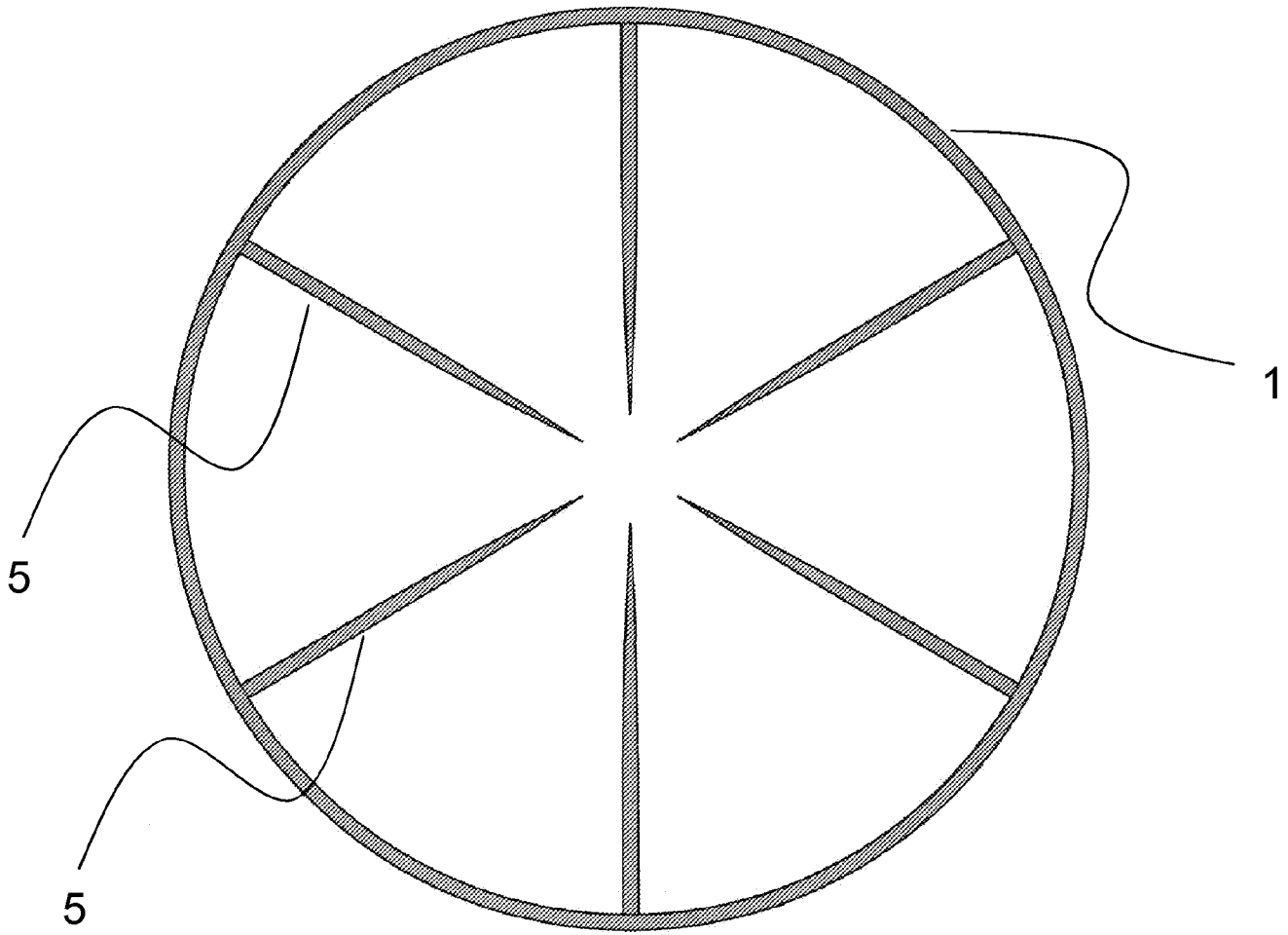
FIG. 1*c* is a section view according to a plane perpendicular to the longitudinal axis of a marine tunnel thruster of the present invention in a possible embodiment.
Figure 1D:
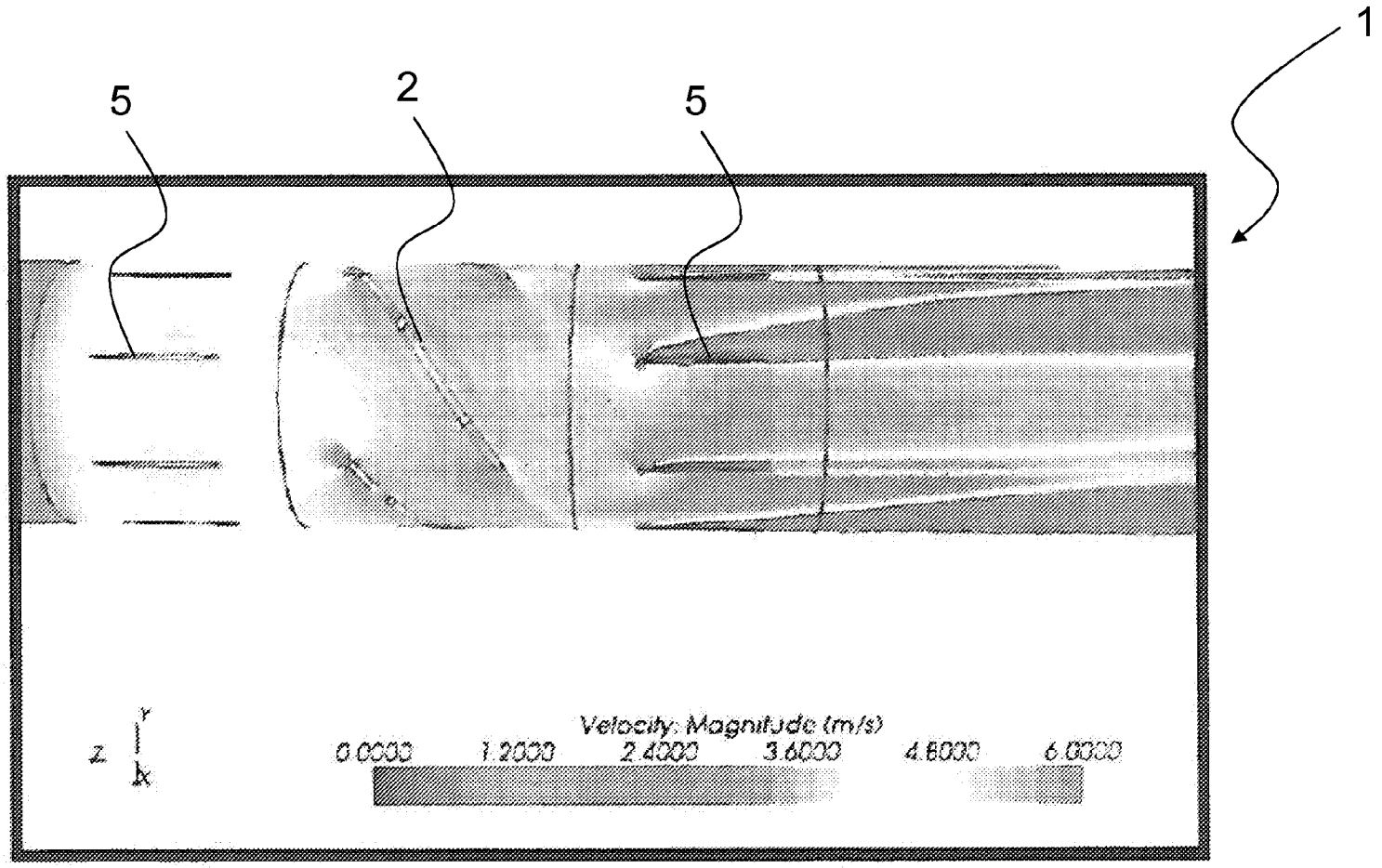
FIG. 1*d* is a view of a marine thruster of the present invention according to the variant embodiment shown in FIG. 1*c;*

For instance, FIGS. 1*c* and 1*d* show a cross-section and an annular section respectively of the duct wall taken at the root of the fixed vanes 5 radially fitted inside a tunnel thruster of the present invention made according to a possible variant embodiment. According to such variant embodiment the array of fixed vanes 5 can be arranged at the two ends of the central tunnel 121 and 123 and/or at the plating opening holes, or even in two intermediate sections within the tunnel itself.

Such vanes 5 have an airfoil section and are radially arranged, structurally rooted at the inner surface of the duct 12, or ducts 11 and 13, and radially project towards the center of the duct. The ends of the vanes faced towards the axis of the duct can be free or can be rigidly connected to each other by a small hub. Such vanes 5 will have symmetric airfoils in the case of bi-directional tunnels (namely able to provide the thrust in either directions), or they will have unsymmetrical airfoils (cambered) for unidirectional tunnels.

The function of this radial array of vanes 5 is to recover the rotational energy exerted on the flow generated by the tunnel propeller 2 and to convert it into a static head, in turn increasing the net thrust generated from the surface under pressure of the tunnel propeller 2.

Vanes 5 have elongated shapes, and their number and their main geometrical features (chord length, radial extension, plan shape and airfoil) as well as the vane profile can be of standard type (NACA) or can be characterized by arrangements of not traditional thicknesses and curvatures, which are defined case by case, depending on the detailed design of the marine tunnel thruster of the present invention.

FIG. 1*b* shows, by areas colored according to the local intensity of the flow, how the velocity of the inner duct belonging to the marine tunnel thruster of the present invention changes. In particular the figure relates to a marine tunnel thruster having the characteristics described up to now, whose propeller draws the fluid from the left and pushes it to the right.

The different areas of the sectional plane are colored as a function of the intensity of the axial velocity of the flow created by the propeller 2 inside the duct, on the basis of the results obtained by a CFD (Computational Fluid Dynamic) simulation.

Preferably, but not exclusively, the diameter A of the central section 12 is substantially equal to, or slightly greater than, the diameter of the circumference ideally drawn by the propeller 2 when rotating about its own axis.

Further experimental tests have confirmed that the axial length L of the central section ranges from two to four times the size of the diameter A of the central section 12.

Particularly FIG. 1*a* shows a marine tunnel thruster of the present invention, wherein the connecting surface is in the form of an abrupt connection with one (as shown) or more steps. According to such variant embodiment the annular connecting enlargement 132 of the facing end sides of the central section 12 and of the corresponding end section 11 and 13 is composed of one or more annular surfaces perfectly radial and perpendicular to the longitudinal axis of the tubular duct 1 with three sections.

In particular the connection with one step or more steps has rectangular shapes with reference to a sectional view along a diametral plane, where the end side 121 of the central section 12 is connected to one of the ends of each one of the two end sections 11 and 13 through surfaces perpendicular to each other.

Figure 2A:
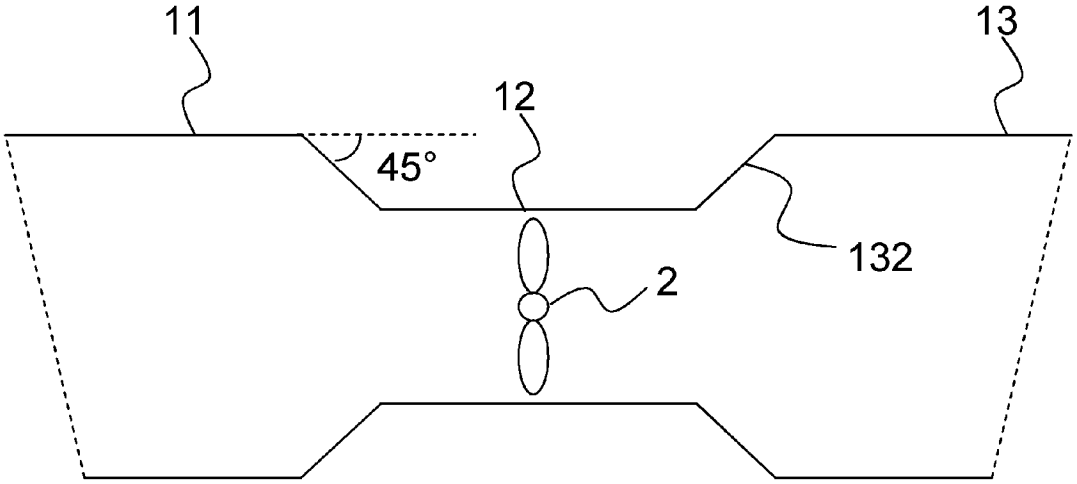
FIGS. 2*a* and 2*b* show a marine tunnel thruster of the present invention, according to a diametral section, wherein the connecting surface is a frustum conical surface.
Figure 2B:
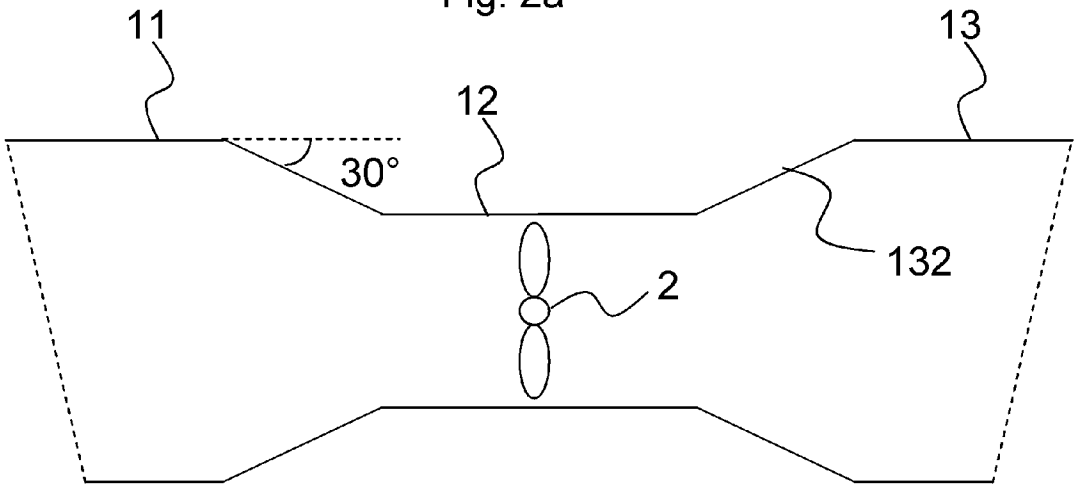

FIGS. 2*a* and 2*b* show, according to a diametric section, an embodiment of the marine tunnel thruster of the present invention, wherein the connecting surface is a frustum conical surface.

The connecting surface 132 therefore is shaped as an inclined plane having a specific angle with respect to the longitudinal axis of the three-section tubular duct 1.

The inclination of the connecting surface can be of any value, but in FIGS. 2*a* and 2*b* two particular inclinations are shown, equal to 45° and 30° respectively.

Figure 3A:
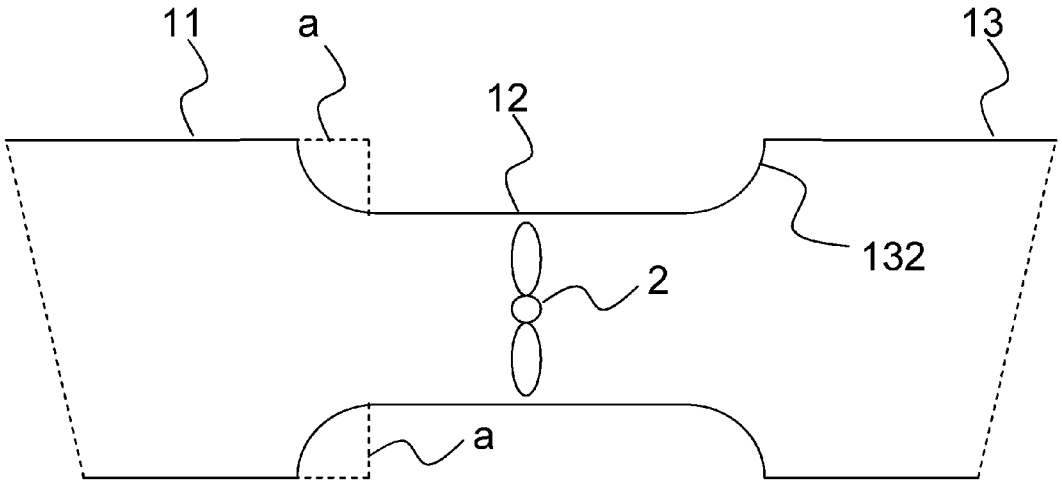
FIGS. 3*a* and 3*b* are the marine tunnel thruster of the present invention, according to a diametral section, wherein the connecting surface is curved, of circular type with constant radius or of the elliptical type, respectively.
Figure 3B:
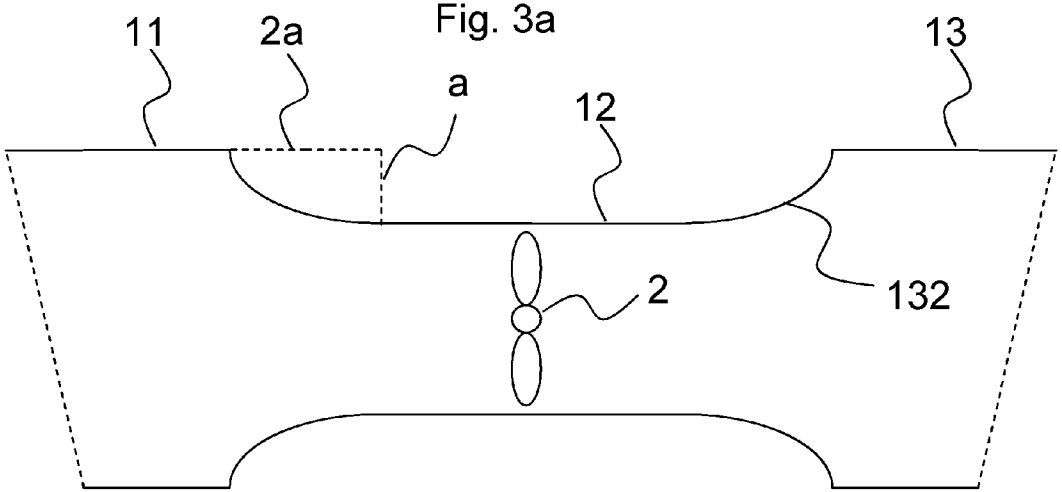

According to a possible variant embodiment, shown in FIGS. 3*a* and 3*b*, of the marine tunnel thruster of the present invention, the connecting surface 132 is composed of a curved surface.

The concavity of the curved surface can be faced to the inner side or the outer side of the three-section tubular duct 1. With particular reference to FIGS. 3*a* and 3*b*, the concavity is faced to the outside of the three-section tubular duct 1.

FIG. 3*a* shows, according to a diametric section, the tubular duct 1 having a connecting surface 132 with a circular shaped profile, namely it has an extension in the axial length equal to the extension in the radial length.

On the contrary FIG. 3*b* shows, according to a diametric section, still a curved connecting surface 132, but this time the profile is of the elliptical type, particularly an elliptical profile having semiaxes with a 1:2 ratio, that is the ratio of the radial semiaxis to the axial one of the elliptical connection is 1 to 2.

Figure 4:
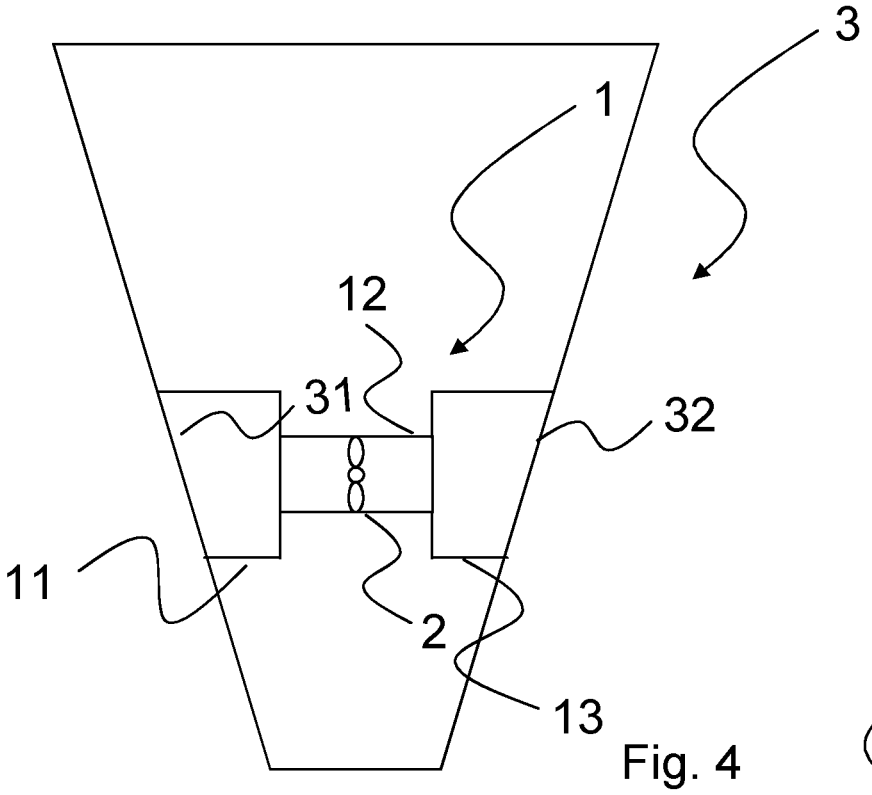
FIG. 4 is a section view according to a vertical plane transverse to the longitudinal axis of the hull of a boat wherein a marine tunnel thruster of the present invention is provided.

FIG. 4 shows a transversal view of the hull area, such as the bow or stern of a marine vehicle, wherein the marine tunnel thruster of the present invention is fitted.

The duct 1 shown in the hull 3 is mounted with its own axis according to a direction transverse to the fore-and-aft axis of the marine vehicle.

The two end sections 11 and 13 come out of the hull 3 at the two opposite sides of the hull 3, through two respective apertures 31 and 32 in the sides, which may be locally flared depending on particular needs due to specific hydrodynamic conditions of the combined operation of the thruster with outer hydraulic flows during the forward motions.

Therefore, FIG. 4 shows a vessel comprising at least one maneuvering propeller 2, which is housed in an intermediate position in the duct 11 oriented transverse to the fore-and-aft axis of the hull 4, and which is open at the two opposite sides of the vessel 4 and at such a level to be under the waterline thereof.

The tubular duct 11 is made according to one or more of the characteristics described in FIGS. 1 to 3*b*.

Figure 5:
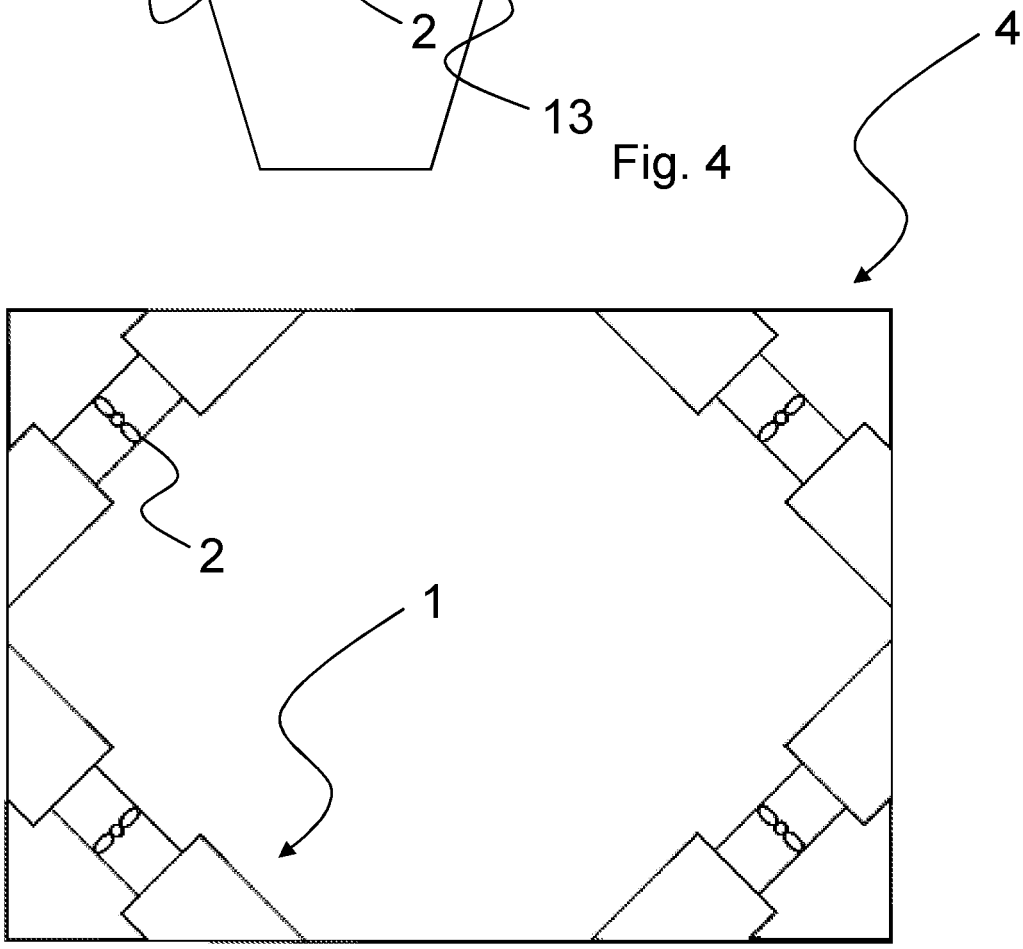
FIG. 5 is a section view according to a horizontal plane of a watercraft device upon which four marine tunnel thrusters of the present invention are mounted.

In particular in FIG. 4 a marine tunnel thruster of the present invention is arranged in the bow of the vessel 4, but it is also possible to provide for it to be arranged at the stern, or both at bow and stern in the case of large units that need several marine thrusters in order to make particular maneuvers at low speeds and/or for docking FIG. 5 shows a section view according to a horizontal plane of a watercraft device upon which four marine tunnel thrusters of the present invention are mounted.

Such preferred embodiment provides for four marine tunnel thrusters 1 to be installed which are made according to the features described up to now and has an angle of about 45° with respect to the fore-and-aft axis of the marine vehicle 4, such as floating pontoon or barge.

Figure 6:
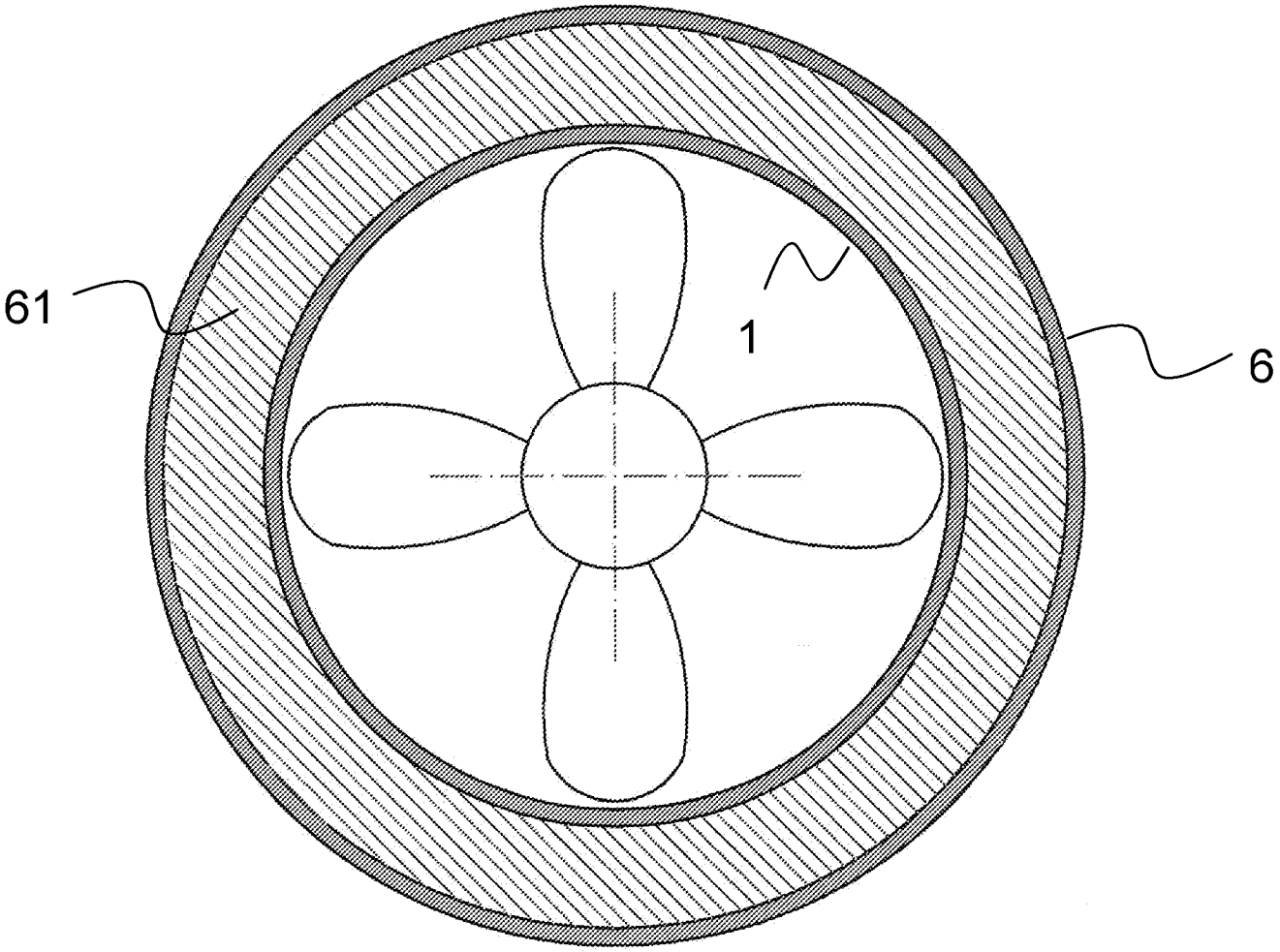
FIG. 6 is a section of a further embodiment of a marine tunnel thruster of the present invention, wherein it is used for reducing irradiated air noise.

FIG. 6 shows a further embodiment of the marine tunnel thruster of the present invention, wherein it is used for reducing the noise and the vibrations transmitted inside the vessel.

Particularly FIG. 6 shows a section according to a plane transverse to the longitudinal axis of the duct 1 of the marine tunnel thruster.

In this case a particular structural solution of the marine tunnel thruster of the present invention is provided, intended to reduce the structural noise transmitted to the surrounding structures and the air noise irradiating into the premises.

The special arrangement provides for an outer covering shell 6, preferably of cylindrical shape and preferably, but not necessarily, coaxial with the duct 1, connected to the duct 1 by means of elements 61 composed of a polymer material of viscoelastic nature. The outer shell 6 can be any metal material, preferably the same type as the inner duct 6, such as steel or aluminum alloy.

Depending on the type of material used, the thickness of the outer shell 6 can range from a minimum of few millimeters to a maximum of several times the thickness of the inner duct 1.

Vibrations exerted by the propeller 2 on the inner duct will be dampened by the viscoelastic material 61 and at the same time will be dissipated due to a mechanical effect by the mass-spring-damper system that is generated between the inner duct 1, the connecting viscoelastic material 61 and the outer shell 6.

The viscoelastic material can be of the type already usually used for damping vibrations propagating into metal structures in the marine field or civil-industrial field.

The mechanical properties of the viscoelastic material in terms of thickness, density and stiffness, will be decided case by case according to geometric, mechanical and structural characteristics of the marine tunnel thruster.

From case to case, for this special implementation it will be decided whether the inner duct and the shell outside the damping band made of viscoelastic material can be rigidly fastened to each other through metal structural elements or have to be insulated from each other, only connected by the viscoelastic material.

In this latter case, always from case to case, it will be decided whether it is possible making the outer shell as floating or whether it is possible making the duct as floating with respect thereto, by defining, depending on the needs deriving from these different possibilities, even the type and the properties of the elastic supports and of the seals of the structural body of the thruster when it is of the mechanical type and it requires a coupling with the prime mover mounted inside the hull.

Figure 7A:
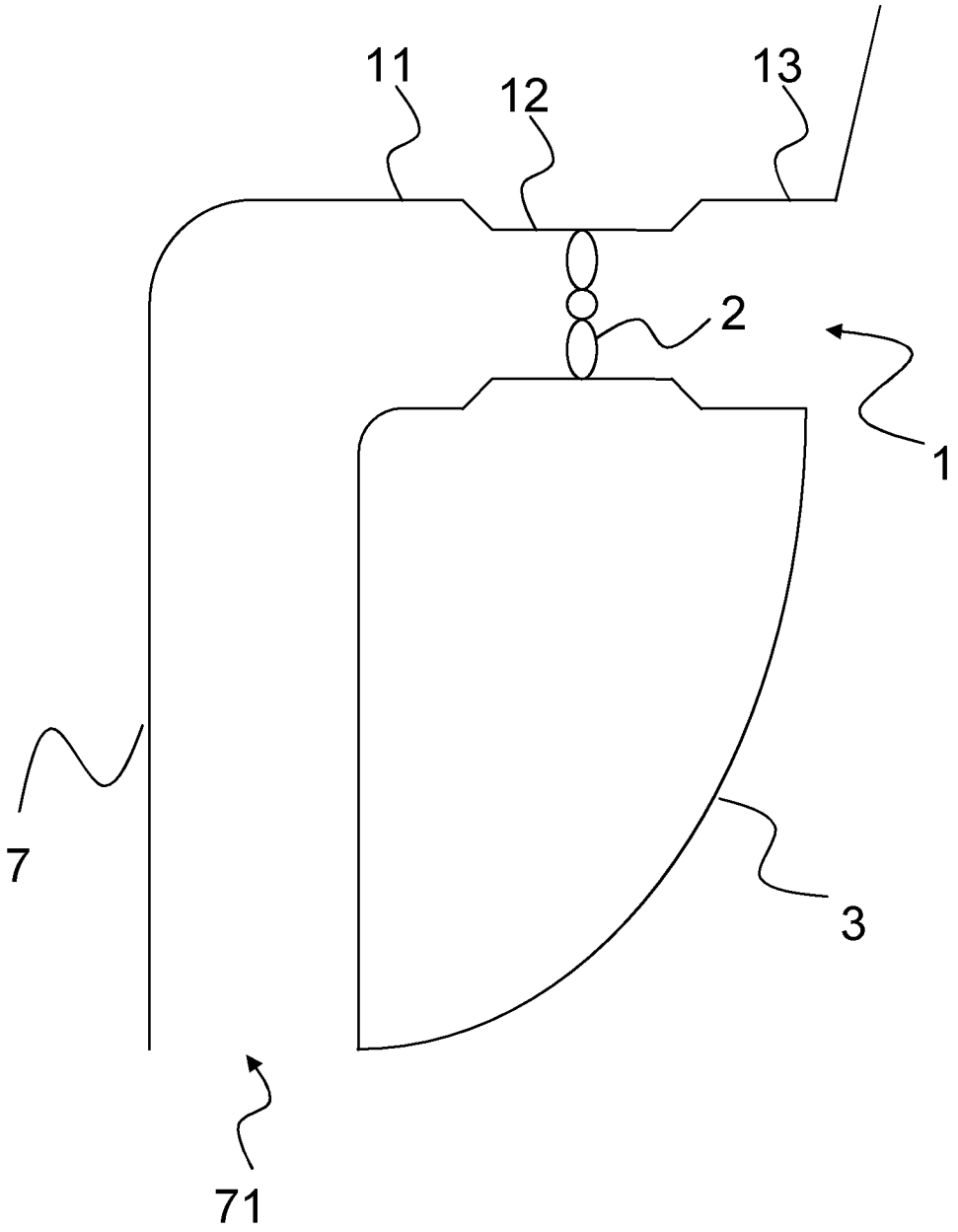
FIGS. 7*a* and 7*b* are a section view according to a horizontal plane of a watercraft device upon which a variant embodiment of a marine tunnel thruster of the present invention is mounted.

FIG. 7*a* shows a section view according to a horizontal plane of a watercraft device, upon which a variant embodiment of the marine tunnel thruster of the present invention is mounted.

According to such arrangement the duct 1 is provided into a hull 3 of a marine working floating vehicle or a vessel 4 or a ship.

The duct 1 is in communication with an additional duct 7 arranged with the longitudinal axis coinciding with and/or parallel to the fore-and-aft axis of the vessel 4.

Preferably such additional duct 7 is arranged such that it comes out with one of its ends in communication with one of the two end sections, particularly the end section 11, such as shown in FIG. 7*a*.

The other end of the additional duct 7 comes out of the hull 3, at the bow, through an aperture 71.

The duct 7 is connected to the end section 11 through a connecting surface that can have all the characteristics of the connecting surfaces described before.

Particularly in FIG. 7*a* the duct 7 is connected to the end section 11 forming a right angle with respect to the longitudinal axis of the duct 1, through a connecting surface that is a frustum conical surface with the concavity faced towards the outer side of the tubular duct 1.

Moreover, according to the variant embodiment shown in FIG. 7*a*, the duct 7 has a diameter with the same size of the diameter of the end sections 11 and 13.

Figure 7B:
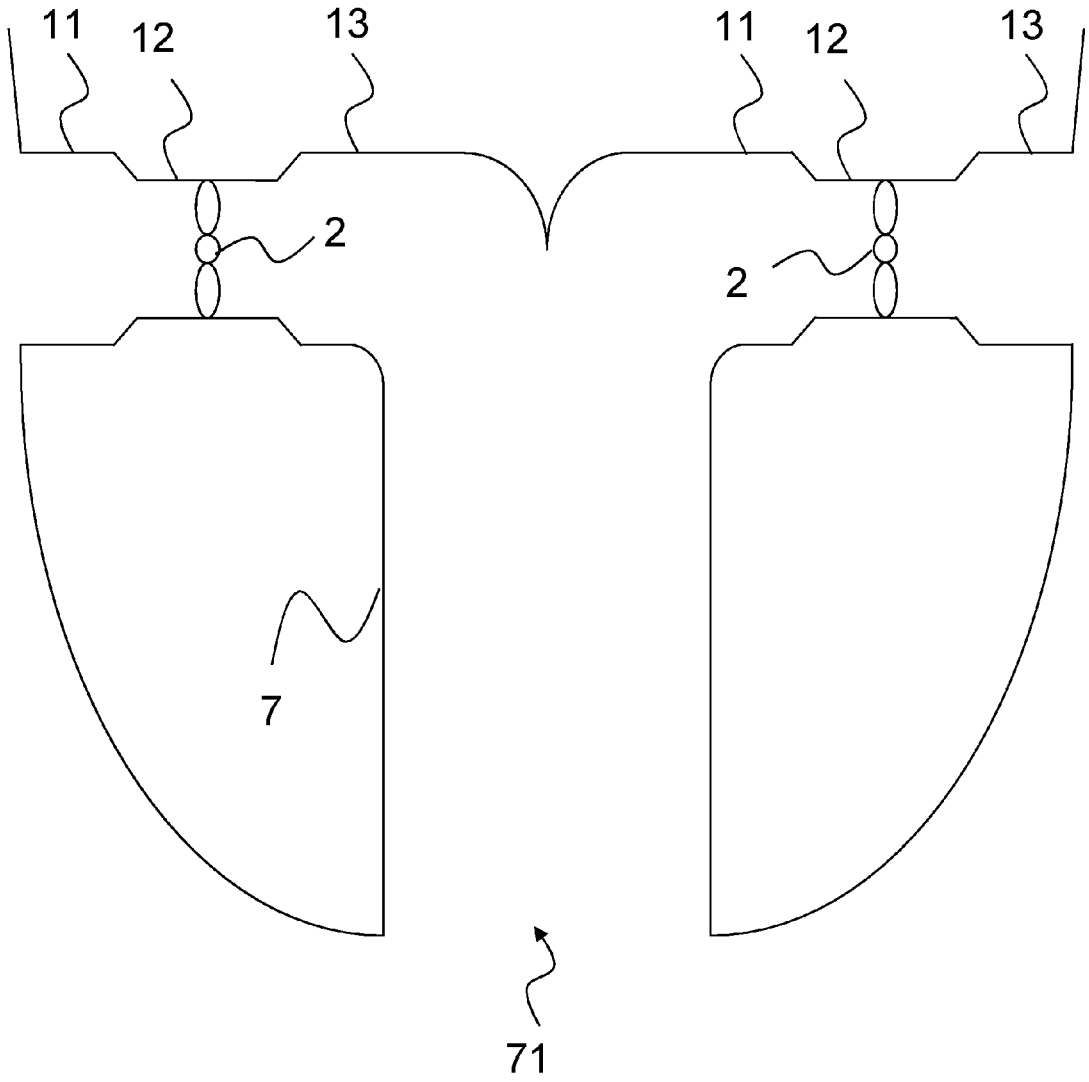

FIG. 7*b* shows a further improvement of the variant shown in FIG. 7*a*, wherein two ducts 1 are provided inside the same hull, the end section 11 of each duct 1 being in communication with an additional duct 7, as previously described.

In this case it is possible to provide a single additional duct 7 in communication with the two end sections, which preferably has a diameter equal to twice the diameter of the duct 7 of FIG. 4*a*.

As an alternative it is possible to provide two ducts 7 side by side, each one preferably with the same diameter.

If the duct 1 is fitted into hulls 5 of vessels of SWATH type or the like, it is possible to provide an arrangement for the additional duct 7 to be in communication with four different ducts 1.

Figure 7C:
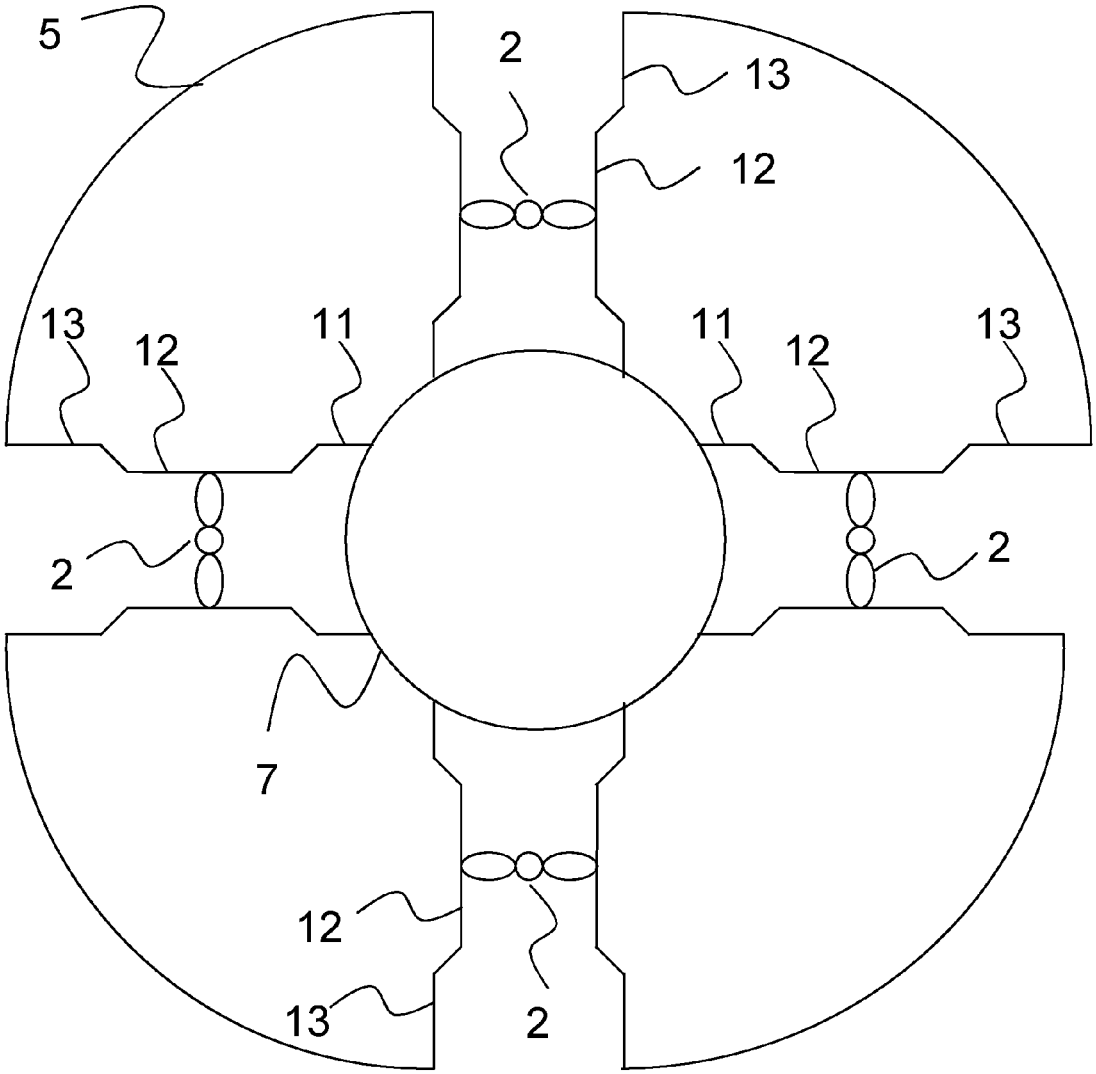
FIG. 7*c* is a section view according to a vertical plane of a hull upon which a variant embodiment of a marine tunnel thruster of the present invention is mounted.

Such arrangement is shown in FIG. 7*c*, showing a section according to a vertical plane, that is a plane perpendicular to the fore-and-aft axis, of a hull of a SWATH vessel or the like.

The duct 7 communicates with the end sections 11 of four ducts 1, arranged on the right, left, top and bottom with respect to the axis of the hull.

In this case preferably the diameter of the duct 7 will have a size greater than or equal to the sum of the diameters of the end sections 11 of the ducts 1.

A possible embodiment of the variant embodiment shown in FIG. 7*c*, provides for the possibility for each propeller to be connected to a different drive means such that each propeller can be moved with its own speed in order to adjust trajectories or maneuvering movements of vessels.

The invention claimed is:

1. A marine thruster comprising:

a tubular duct (1) with a propeller (2) fitted therein which is operatively connected to a drive system allowing the propeller to be rotated about an axis parallel to a longitudinal axis of said duct (1), wherein said tubular duct (1) is composed of three sections comprising a first central section (12) extending between two end sections (11, 13), said first central section (12) housing said propeller (2) and having a first axial length (L) and a first diameter (A), the two end sections (11, 13) having a second axial length (M) and a second diameter (B) which is greater than the first diameter (A) of the central section (12), said end sections (11, 13) being connected to said central section (12) by a radial annular enlargement (132) having an inner surface that is inclined by at least 30° in relation to the longitudinal axis of the duct, and wherein the two end sections (11, 13) are connected to a first end side (121) and to a second end side (123) of the first central section (12) respectively by an annular connecting surface (132) causing an increase in diameter in a direction of a longitudinal axis of the duct (1), and wherein a length of the annular connecting surface is defined by:

$$a = k(B - A)$$

where:

a=the length of the annular connecting surface, k=1 if the annular connecting surface has a lateral profile shaped as a quarter of an ellipse having a 2:1 ration of major and minor diameters, otherwise k=0.04–4.0.

2. The marine thruster according claim 1, wherein the second diameter (B) of each of said two end sections (11, 13) is a function of the first diameter (A) of said central section (12).

3. The marine thruster according to claim 1, wherein the second diameter (B) of each of said two end sections (11, 13) has a value falling within a range defined by a size of the first diameter (A) of said central section (12) multiplied by a first factor defining a limit of said range and multiplied by a second factor defining another limit of the range, said first factor and said second factor being defined according to a length of said duct (1) or according to a velocity of a fluid flowing into said duct (1).

4. The marine thruster according to claim 1, wherein said annular connecting surface is shaped as a step connection, wherein an annular enlargement connecting the end sides (121, 123) of the central section (12) and of the corresponding end section (11, 13) is an annular surface perfectly radial and perpendicular to the longitudinal axis of the tubular duct (1).

5. The marine thruster according to claim 1, wherein said annular connecting surface is shaped as a step connection, said step connection having a rectangular shape with reference to a sectional view taken along a diametric plane, and end side of said central section (12) being connected to one of the ends of each of said two end sections (11, 13) by two surfaces perpendicular to each other.

6. The marine thruster according to claim 1, wherein said annular connecting surface is a frustum conical surface.

7. The marine thruster according to claim 1, wherein the annular connecting surface is curved and has a concavity faced towards an inner or outer side of the tubular duct (1).

8. The marine thruster according to claim 1, wherein said tubular duct (1) is provided within a hull (3) of a marine floating working system or a boat (4) or a vessel, said two end sections (11, 13) coming out from the hull (3) at sides of the hull, through two respective apertures (31, 32) provided in said sides, said apertures (31, 32) coinciding with the end sides of the two end sections (11, 13).

9. The marine thruster according to claim 1, wherein said tubular duct (1) is provided into a hull (3) of a boat (4) or a vessel, said duct (1) being fitted to be oriented with its longitudinal axis transversely to the fore-and-aft axis of said boat (4) or vessel.

10. The marine thruster according to claim 1, wherein said tubular duct (1) has one or more fixed vanes (5) fitted therein, said vanes having an airfoil section and an elongated shape, each vane (5) being arranged radially to the longitudinal axis of said duct (1), with a first end connected to an inner surface of said duct (1), while a second end radially faces the longitudinal axis of said duct (1.

11. A marine thruster comprising:

a tubular duct (1) with a propeller (2) fitted therein which is operatively connected to a drive system allowing the propeller to be rotated about an axis parallel to a longitudinal axis of said duct (1), wherein said tubular duct (1) is composed of three sections comprising a first central section (12) extending between two end sections (11, 13), said first central section (12) housing said propeller (2) and having a first axial length (L) and a first diameter (A), the two end sections (11, 13) having a second axial length (M) and a second diameter (B) which is greater than the first diameter (A) of the central section (12), said end sections (11, 13) being connected to said central section (12) by a radial annular enlargement (132) having an inner surface that is inclined by at least 30° in relation to the longitudinal axis of the duct, wherein said tubular duct (1) is provided into a hull (3) of a marine floating working vehicle, a boat (4) or a vessel, said duct (1) extending longitudinally to define an additional duct (7) having a longitudinal axis coinciding with or parallel to a fore-and-aft axis of the boat, said additional duct ending at the bow with an aperture (71), wherein said additional duct (7) is connected to one of said two end sections (11, 13) through a connecting surface causing an increase in diameter in a direction of a longitudinal axis of the duct (1), and wherein a length of the connecting surface is defined by:

$$a = k(B - A)$$

where:

a=the length of the connecting surface, k=1 if the connecting surface has a lateral profile shaped as a quarter of an ellipse having a 2:1 ration of major and minor diameters, otherwise k=0.04–4.0.

12. The marine thruster according to claim 1, wherein said tubular duct (1) has an outer covering shell (6), said covering shell (6) being connected to an outer surface of said tubular duct (1) by polymeric elements (61) of visco-elastic nature configured to absorb vibrations caused by the propeller.

13. A watercraft comprising:

at least a maneuvering propeller (2), housed in an intermediate location into a tubular duct (1) oriented with a specific inclination with respect to the fore-and-aft axis of said watercraft and at such a level that an axis of rotation of the propeller is below or at a waterline thereof, wherein said tubular duct (1) is composed of three sections comprising a first central section (12) and two end sections (11, 13), the first central section (12) having a specific length (L) and a specific diameter (A), and the two end sections (11, 13) having a specific length (M) and a specific diameter (B), the specific diameter (B) of the two end sections being greater than the specific diameter (A) of the central section (12), said end sections (11, 13) being connected to said central section (12) by a radial annular enlargement having a inner surface that is inclined by at least 30° in relation to a longitudinal axis of said tubular duct, and wherein the two end sections (11, 13) are connected to a first end side (121) and to a second end side (123) of the first central section (12) respectively by an annular connecting surface (132) causing an increase in diameter in a direction of the longitudinal axis of the duct (1), and wherein a length of the annular connecting surface is defined by:

$$a = k(B - A)$$

where:

a=the length of the annular connecting surface, k=1 if the annular connecting surface has a lateral profile shaped as a quarter of an ellipse having a 2:1 ration of major and minor diameters, otherwise k=0.04–4.0.

* * * * *